US012024340B2

(12) United States Patent
Boehm

(10) Patent No.: US 12,024,340 B2
(45) Date of Patent: Jul. 2, 2024

(54) FLIP-TOP CAP FOR DISPENSING A FLOWABLE DENTAL SUBSTANCE

(71) Applicant: Solventum Intellectual Properties Company, Maplewood, MN (US)

(72) Inventor: Andreas J. Boehm, Reichling (DE)

(73) Assignee: Solventum Intellectual Properties Company, Maplewood, MN (US)

( * ) Notice: Subject to any disclaimer, the term of this patent is extended or adjusted under 35 U.S.C. 154(b) by 820 days.

(21) Appl. No.: 15/733,606

(22) PCT Filed: Mar. 20, 2019

(86) PCT No.: PCT/IB2019/052262
§ 371 (c)(1),
(2) Date: Sep. 14, 2020

(87) PCT Pub. No.: WO2019/186326
PCT Pub. Date: Oct. 3, 2019

(65) Prior Publication Data

US 2021/0171247 A1 Jun. 10, 2021

(30) Foreign Application Priority Data

Mar. 28, 2018 (EP) ..... 18164453

(51) Int. Cl.
*B65D 47/08* (2006.01)
*B65D 47/18* (2006.01)

(52) U.S. Cl.
CPC ..... *B65D 47/0809* (2013.01); *B65D 47/18* (2013.01); *B65D 2251/1025* (2013.01); *B65D 2251/1058* (2013.01); *B65D 2251/20* (2013.01)

(58) Field of Classification Search
CPC ..... B65D 47/0809; B65D 47/18; B65D 2251/1025; B65D 2251/1058; B65D 2251/20
See application file for complete search history.

(56) References Cited

U.S. PATENT DOCUMENTS 3,045,860 A * 7/1962 Desgagne ..... B65D 51/04 D9/450
3,209,963 A * 10/1965 Krieps ..... B65D 47/0842 222/542
3,240,405 A * 3/1966 Abbott ..... B65D 47/0838 222/546

(Continued)

FOREIGN PATENT DOCUMENTS

JP 63281817 A 11/1988
JP 2007021961 A 2/2007

(Continued)

OTHER PUBLICATIONS

International Search Report for PCT International Application No. PCT/IB2019/052262, dated Jul. 25, 2019, 5 pages.

*Primary Examiner* — James N Smalley
(74) *Attorney, Agent, or Firm* — Kevin Weber

(57) ABSTRACT

A flip-top cap (83) for dispensing a flowable dental substance which is monolithically formed of a thermoplastic material. The flip-top cap has a base (4) from which a dropper nose (8) protrudes and a closure that is hingedly connected to the base for pivoting between a closed position, in which the closure closes the dropper nose, and an open position, in which the dropper nose is uncovered from the closure. The closure has an end wall (20) forming an outward planar end face (21) and, opposite thereof, an inner face (22) that has a sealing bulge (23). The end wall forms a first thickness (T1) between the vertex of the sealing bulge and the end face and a second thickness (T2) between a marginal area adjacent the sealing bulge and the end face. The ratio between the first and second thickness is between 1.4 and 1.6.

14 Claims, 3 Drawing Sheets

(56) References Cited

U.S. PATENT DOCUMENTS 4,281,778 A * 8/1981 Stull ..... B65D 47/148
215/214
4,739,906 A * 4/1988 Lo ..... B65D 47/2081
222/484
4,915,268 A * 4/1990 Lay ..... B65D 47/0809
220/837
5,246,145 A * 9/1993 Leoncavallo ..... B65D 47/18
222/542
5,642,824 A * 7/1997 Hess, III ..... B65D 47/0809
220/838
5,743,443 A * 4/1998 Hins ..... B65D 47/2031
222/490
6,409,034 B2 * 6/2002 Schorner ..... B65D 47/0828
220/838
7,325,708 B2 * 2/2008 Barber ..... A61F 9/0026
604/300
2001/0040176 A1 * 11/2001 Kimble ..... B65D 47/0814
222/546
2006/0037972 A1 * 2/2006 Leiner ..... A61C 5/62
222/212
2006/0111680 A1 * 5/2006 Spada ..... B65D 47/18
604/295
2006/0201904 A1 * 9/2006 Comeau ..... B65D 47/0828
220/254.5
2015/0216723 A1 8/2015 Yoshimura
2017/0008678 A1 1/2017 Walter

FOREIGN PATENT DOCUMENTS

JP 2017203547 A 11/2017
WO 9957030 A1 11/1999
WO WO 2011-056814 5/2011
WO WO-2011056814 A1 * 5/2011 ..... B65D 47/0809
WO WO 2015-002296 1/2015

* cited by examiner

FLIP-TOP CAP FOR DISPENSING A FLOWABLE DENTAL SUBSTANCE

CROSS REFERENCE TO RELATED APPLICATIONS

This application is a national stage filing under 35 U.S.C. 371 of PCT/IB2019/052262 filed Mar. 19, 2019, which claims the benefit of European Application No. 18164453.5, filed Mar. 28, 2018, the disclosure of which is incorporated by reference in its/their entirety herein.

FIELD OF THE INVENTION

The invention relates to a flip-top cap for dispensing a flowable dental substance which is monolithically formed of a thermoplastic material. A sealing bulge is monolithically formed with the flip-top cap and provided for sealing an outlet of a dropper nose of the flip-top cap.

BACKGROUND ART

Dental materials are often provided in packages that are designed to facilitate preparation and/or application of the materials in a dentist's practice. Flowable dental materials are often provided in dropper bottles which allow the material to be dispensed in droplets so that a desired amount can be easily metered by a user.

For example WO 2011/056814 A1 discloses a dispenser that has a body with an outlet, and a flip-top cap for the outlet. The flip-top cap and the body are pivotally movable relative to each other between an open position in which the outlet is open and a closed position in which the flip-top cap closes the outlet. The flip-top cap and the body are adapted for locking engagement with each other in the closed position. The flip-top cap has a locking member for locking and unlocking the flip-top cap and the body in the closed position. A force applied on the locking member for unlocking urges the flip-top cap toward the open position.

Although existing dropper bottles are used and useful in dentistry there is still a need for a dispenser that is reliable in and easy to use and which is relatively inexpensive.

SUMMARY OF THE INVENTION

The invention relates to a flip-top cap for dispensing a flowable dental substance. Further, the invention relates to a dispenser that comprises the flip-top cap. The flip-top cap is monolithically formed of a thermoplastic material. The flip-top cap comprises a base from which a dropper nose protrudes and a closure that is hingedly connected, in particular by means of a hinge, to the base. The hinge is provided for pivoting between a closed position, in which the closure closes the dropper nose, and an open position, in which the dropper nose is uncovered from the closure. Thus, the closure and the base are movable between the open position and the closed position by means of the hinge. The closure comprises an end wall forming an outward planar end face and, opposite thereof, an inner face that comprises a sealing bulge. The end wall forms a first thickness between the vertex of the sealing bulge and the end face. Further the end wall forms a second thickness between a marginal area adjacent the sealing bulge and the end face. The ratio between the first and second thickness is between 1.4 and 1.6.

The invention is advantageous in that it provides for a flip-top cap that is easy to clean and therefore a flip-top cap which is suitable for use in dentistry. Further, the invention is advantageous in that it provides for a flip-top cap that provides a tight seal in the closed position. Furthermore, the invention provides for a flip-top cap which can be made from a single material. A so formed cap is relatively inexpensive.

In one embodiment the dropper nose has a free end that forms an outlet channel. The outlet channel preferably conically widens toward the free end. Thus, the outlet channel is shaped to enable the formation of droplets from the flowable dental material during dispensing. Further, the conical shape of the outlet channel cooperates with the shape of the sealing bulge to provide a tight sealing in the closed position of the flip-top cap.

In one embodiment the outlet channel forms a dispensing outlet having a diameter of 2.8 mm. Preferably the narrowest portion of the outlet channel is 0.6 mm. Thus the outlet channel is sized to restrict a flow rate of the flowable dental material and thereby enables a controlled dosing of the flowable dental material and prevents spilling of the flowable dental material. Further the outlet channel is sized to provide a predetermined volume of droplets that can be dispensed.

In one embodiment the sealing bulge protrudes in a direction away from the inner face of the closure. The sealing bulge preferably protrudes at a circular cross-section that reduces in diameter in the direction away from the inner face. In particular the sealing bulge is preferably dome-shaped. The dome-shape may comprise a spherical surface having a radius of 4 mm. The spherical surface preferably forms the vertex of the sealing bulge. Further, the spherical surface may form a first portion of the overall surface of the sealing bulge and a second portion of the sealing bulge may be non-spherical.

In one embodiment the base forms a cylindrical shoulder. The shoulder and the closure preferably snugly fit with each other in the closed position. Thus the closure and the base in combination form a second seal in addition to a first seal provided by the sealing bulge sealing the dropper nose in the closed position. Accordingly, the flip-top cap provides for two seals that are based on different sealing principles. Thereby the sealing effect can be maximized.

In one embodiment the flip-top cap comprises a first retention structure at the closure and a second retention structure at the base. The first and second retention structure are snapped into each other in the closed position.

In one embodiment the flip-top cap comprises an inner thread for mating with an outer thread of a container bottle. The flip-top cap may comprise the container bottle. The container bottle and the flip-top cap may in combination form the dispenser for the dental material. Further the flip-top cap or the dispenser may comprise the dental material contained in the container bottle.

In one embodiment the hinged connection between the closure and the base is formed by a bistable living hinge which urges the closure and the base to either of the closed and open position. Preferably the closure and the base are pivotable by 180 degrees for establishing the open and the closed position. This means that the open and the closed position are 180 degrees angularly offset from each other. This enables the closure to be positioned entirely away from the dropper nose. Thus the dropper nose can be freely positioned during dispensing the dental substance while the closure is positioned well outside an area around the dropper nose. Preferably the dropper nose protrudes along a longitudinal axis from a bottom end from the base over a length to the free end (that forms the dispensing oulet). The hinge is preferably arranged radially of the bottom end. The pivot provided by the hinge preferably forms a pivot axis that is perpendicular to the longitudinal axis. The length of the dropper nose is preferably 14.5 mm and the radial distance of the pivot axis is preferably 10.75. Due to the geometric arrangement of the hinge relative to the sealing bulge, a movement of the closure from the closed position toward the open position causes the sealing bulge to slide off from the free end in a direction laterally from the longitudinal axis. The shape of the dome-shape and the geometric arrangement of the hinge relative to the sealing bulge (as defined herein) are configured such that smooth opening and closing of the closure is enabled and such that in the closed position a pretension between the sealing bulge and the dropper nozzle is created. Preferably the flip-top cap is made (in particular injection molded) of polypropylene.

In one embodiment the closure entirely encapsulates the dropper nose in the closed position. Thus the dropper nozzle is prevented from a contact with the environment during storage of the flip-top cap or the dispenser.

DETAILED DESCRIPTION OF THE INVENTION

Figure 1:
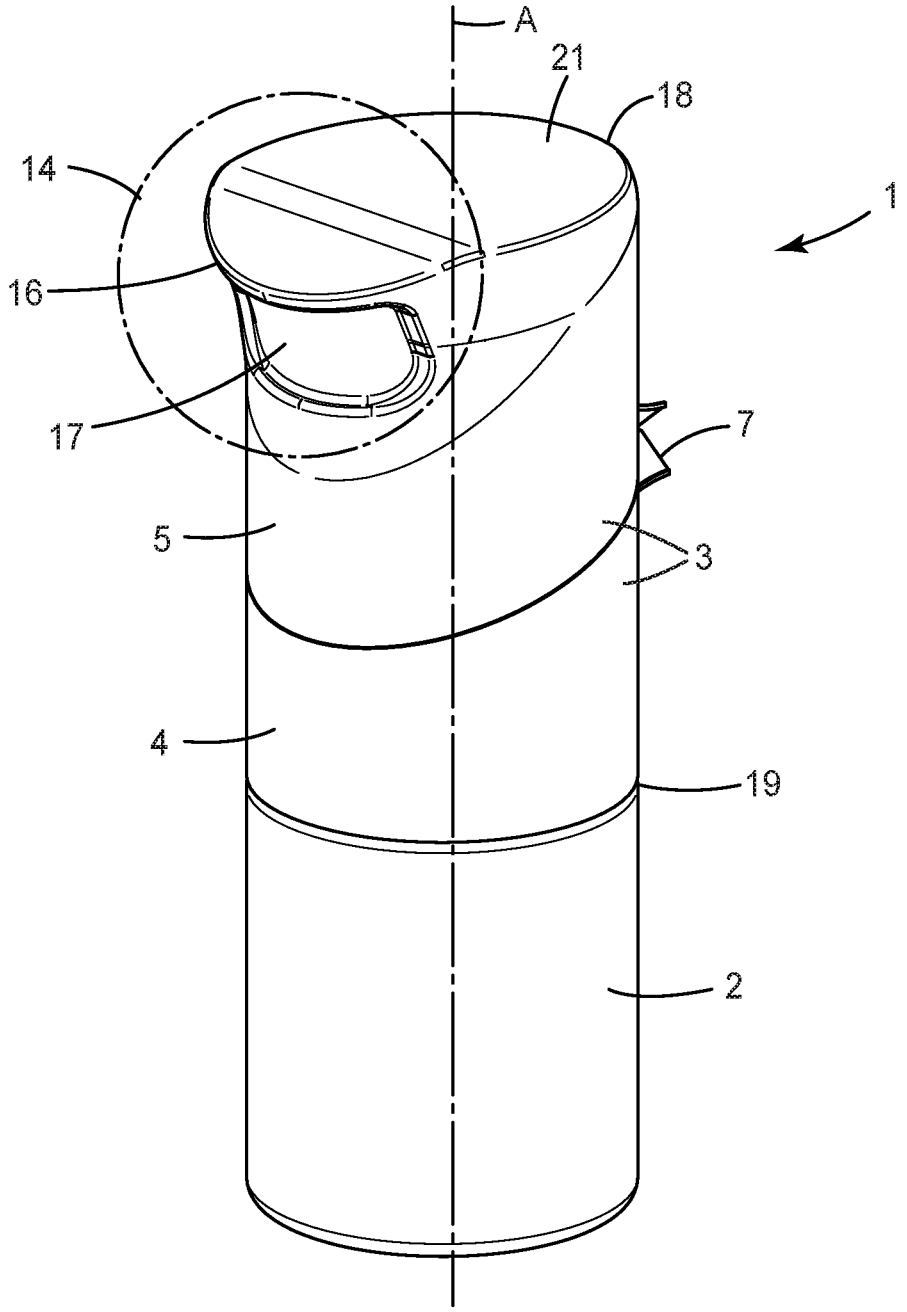
FIG. 1 is a perspective view of a dispenser having a flip-top cap according to an embodiment of the invention in a closed position.
Figure 2:
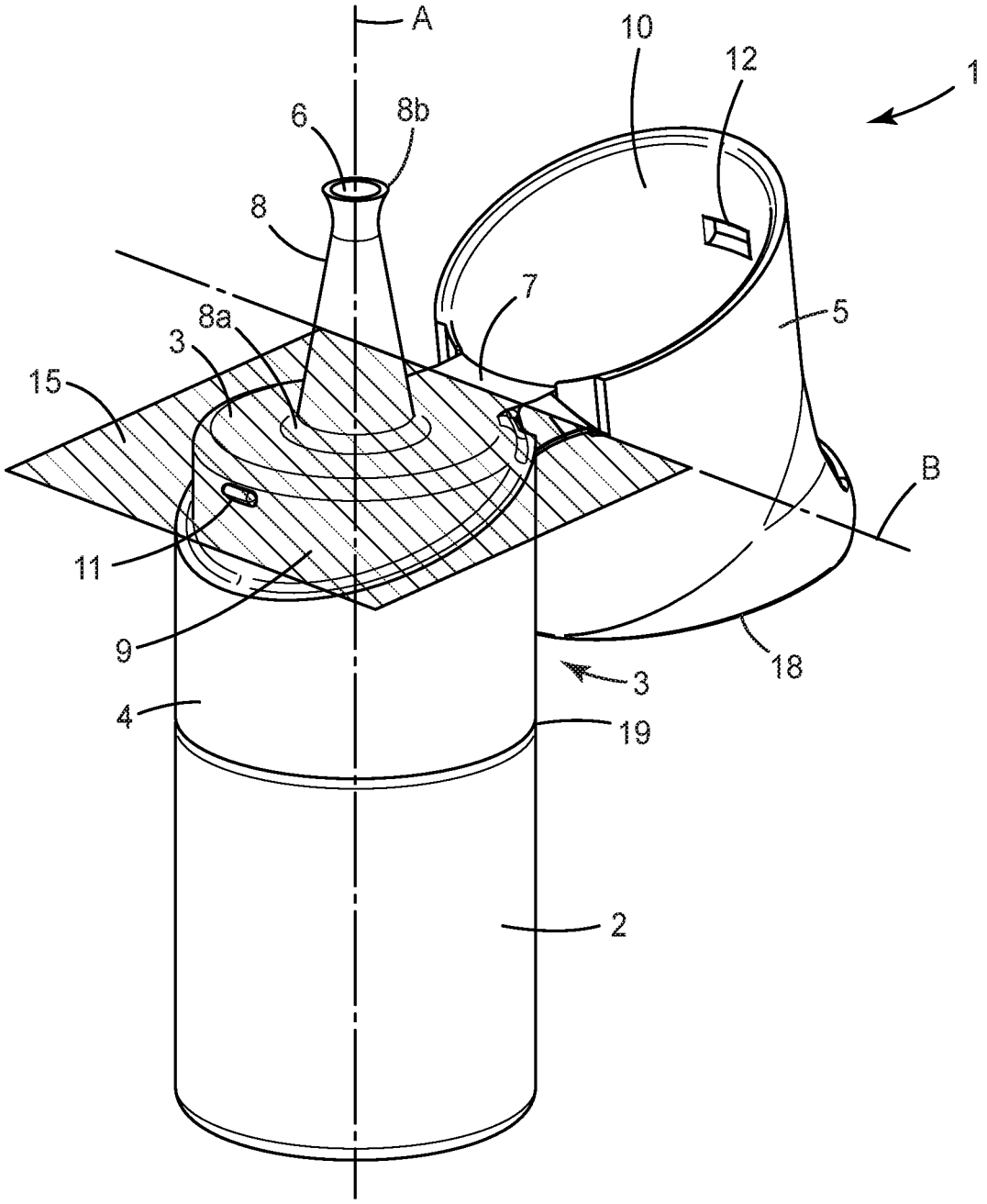
FIG. 2 is a perspective view of the dispenser of FIG. 1 in an open position.

FIGS. 1 and 2 show a dispenser 1 for a flowable dental substance. The dispenser 1 has a bottle 2 and a flip-top cap 3. The flip-top cap 3 has a base 4 and a closure 5 that are interconnected by a hinge 7 so that the closure 5 and the base 4 can be swiveled relative to each other between a closed position (shown in FIG. 1) and an open position (shown in FIG. 2). The closure 5, the base 4 and the hinge 7 are injection-molded in one piece (monolithically formed). The hinge 7 particularly forms a living hinge. The living hinge provides for the swiveling based on a deformation of a thin band of plastic material (and not on two parts that move relative to each other by a sliding fitting). In the example, the hinge 7 further is a bistable hinge that urges the closure 5 and the base 4 toward either of the closed or the open position, and prevents the closure 5 and the base 4 from self-positioning in an intermediate position between the open and the closed position.

As shown in FIG. 2 a dropper nose 8 protrudes from the base 4. The dropper nose 8 protrudes from a bottom end 8*a* from the base 4 over a length of 14.5 mm to a free end 8*b* in which a dispensing outlet 6 is provided. The dispensing outlet 6 is provided for droplet-wise dispensing of the flowable dental substance stored in the bottle 2. For dispensing the flowable substance the dispenser 1 is typically held with the dispensing outlet 6 down (and the bottle up). The bottle 2, so held in place, can be (slightly) squeezed for dispensing the substance. The outlet 6 is formed by a dropper nose 8 (which is described in further detail below).

The base 4 has a shoulder 9 for sealing with the closure 5. In particular, a side wall 10 formed by the closure 5 and the shoulder 9 are dimensioned to snugly and sealingly fit with one another in the closed position of the dispenser 1.

Further, the side wall 10 has a first retention structure 12 and the base 4 (in particular the shoulder 9) has a second retention structure 11. In the example the first retention structure 12 is a recess and the second retention structure 11 is a bulge. The first and second retention structure 11, 12 are positioned and configured such that they engage with each other in the closed position of the dispenser 1. Thus, the first and second retention structure 11, 12 retain the closure 5 and the base 4 in the closed position by means of a snap-retention. The skilled person is aware that the first retention structure may likewise be a bulge or other positive structure and the second retention structure may be a recess or other negative structure. Other retention structures are possible.

The dispenser 1 extends along a longitudinal axis A. Further, the dispenser 1 has an overall cylindrical shape (as visible in FIG. 1) except for an actuator portion 14. The actuator portion 14 is shaped to allow a user to push the closure 5 toward the open position, for example with a thumb. For pushing the closure 5 toward the open position the user may place the dispenser 1 in one hand, holding the dispenser at the bottle 2 with the fingers of that hand and using the thumb of the same hand to push the closure 5 toward the open position. Accordingly, the dispenser 1 enables a single-handed operation. The actuator portion 14 particularly forms a protrusion that protrudes in a dimension transverse to the longitudinal axis A. Further the actuator portion 14 forms an indentation 17. The indentation 17 helps positioning and retaining a user's thumb or finger at a desired position for reliably pushing the closure 5 toward the open position.

The hinge 7 forms a swivel axis B that is arranged offset from the longitudinal axis A and oriented transverse, in particular perpendicular to the longitudinal axis A. The swivel axis B is defined within a virtual hinge-level plane 15 that is perpendicular to the longitudinal axis A. It is noted that the skilled person appreciates that the swivel axis B formed by the hinge may in some embodiments undergo a slight parallel or generally parallel displacement during swiveling. This shall however be covered by the present invention.

The flip-top cap 3 has a first end 18 and a second end 19. In the example the hinge-level plane 15 is arranged between the first end 18 and the second end 19.

Figure 3:
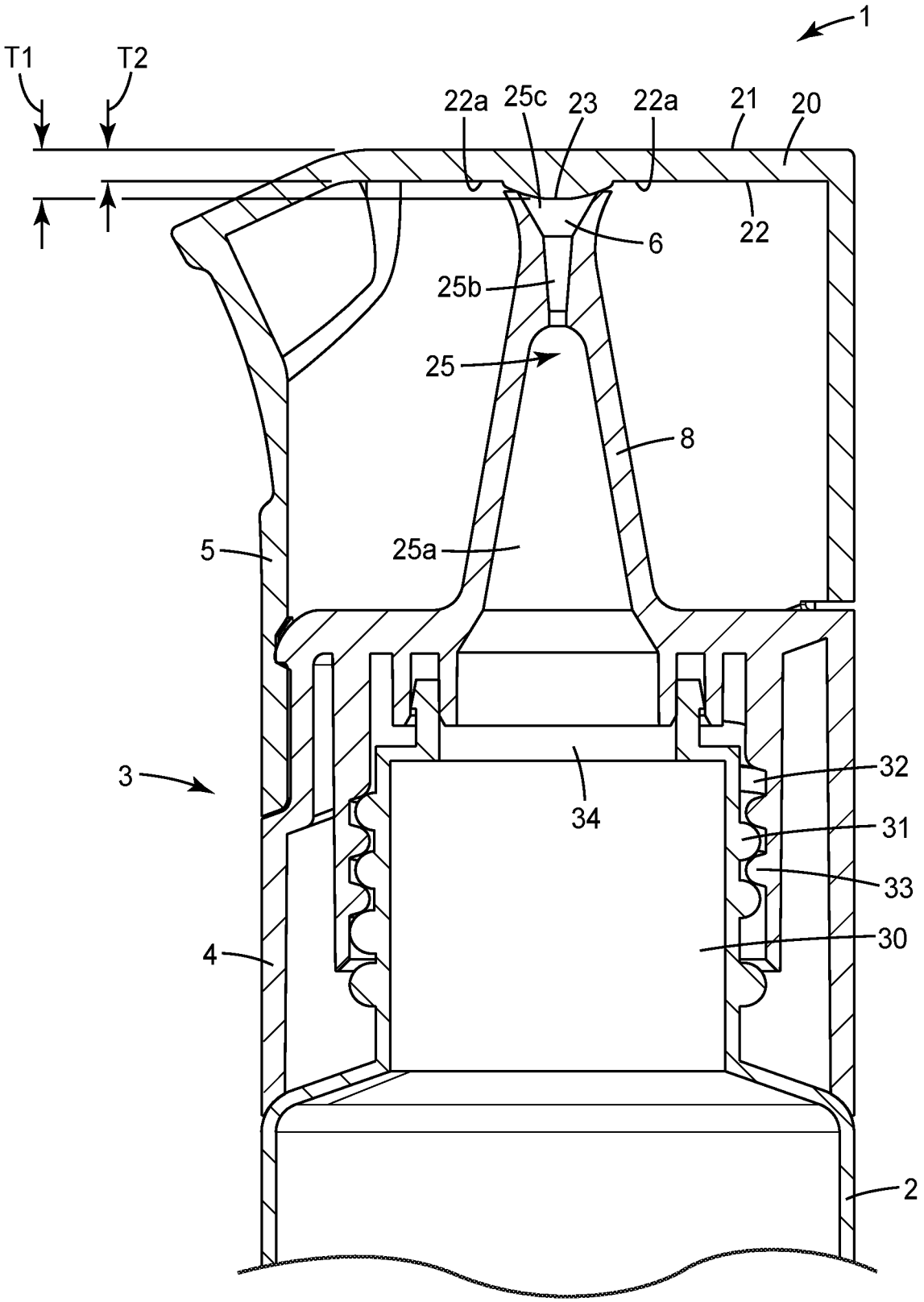
FIG. 3 is a cross-sectional view of the dispenser shown in FIGS. 1 and 2.

FIG. 3 shows the dispenser 1 in a cross-sectional partial view. The closure 5 comprises an end wall 20 that forms an outward planar end face 21 and, opposite thereof, an inner face 22 that comprises a sealing bulge 23. The end wall 20 forms a first thickness T1 between the vertex of the sealing bulge 23 and the end face 21. Further the end wall 20 forms a second thickness T2 between a marginal area 22*a* of the inner face 22 adjacent the sealing bulge 23 and the end face 21. The ratio between the first and second thickness T1:T2 (T1 divided by T2) in the example is approximately 1.5. It has been found, that up to this ratio the end face 21 can be molded planar. In case the ratio is greater than 1.6 (for example by providing a sealing bulge that protrudes farther away from the end wall 20), the end face 21 tends to form a dimple or slight cavity opposite of the sealing bulge 23 due to material shrinkage after injection molding. It is however desirable that the end face 21 is flat (planar) so that it can be disinfected efficiently and easily. This is achieved by the invention. On the other hand it has been found that a smaller ratio than 1.4 between the first and second thickness T1:T2 affects the sealing effect of the sealing bulge when sealing the dispensing outlet 6. In particular a flat seal, as used in the form of a rubber seal in the prior art, may fail over a longer storage time if it is made from a thermoplastic material. This is because thermoplastic materials tend to slightly deform over time if kept under mechanical tension.

The bottle 2 in the example has a neck 30 having an outer thread 31 which is mounted in a receptacle 32 of the base 4. The receptacle 32 has an inner thread 33 which is a corresponding counter thread of the outer thread 31 of the bottle 2. Although a thread connection between the bottle 2 and the flip-top cap 3 is preferred, the skilled person is aware of other connections that may likewise be used with the present invention. Other examples comprise a snap or plug connection, a welded connection an adhesive connection and other appropriate connections. In the example the dispenser 1 has a plug connection in combination with the thread connection. In particular, the bottle 2 has a sealing rim that forms a free end of the bottle 2.

The bottle 2 has an opening 34 (which is the only opening of the bottle 2). The opening 34 of the bottle 2 is in fluid communication with an outlet channel 25 provided within the dropper nose 8. In the example the outlet channel 25 has a first portion 25*a*. The first portion 25*a* tapers from approximately the opening 34 of the bottle 2 in a direction toward the outlet 6. Further, the outlet channel 25 has a second portion 25*b* and a third portion 25*c*. The third portion 25*c* starts at the second portion 25*b* and widens toward the outlet 6. In particular, the third portion 25*c* forms an inner funnel-shaped surface that forms the outlet 6 at an end of the third portion 25*c*. The inner funnel-shaped surface in combination with the outlet 6 and the physical properties of the flowable substance provide for forming droplets of a reliably reproducible drop size during dispensing.

What is claimed is:

1. A flip-top cap for dispensing a flowable dental substance, the flip-top cap being monolithically formed of a thermoplastic material, and comprising a base from which a dropper nose protrudes and a closure that is hingedly connected to the base for pivoting between a closed position, in which the closure closes a dispensing outlet in the dropper nose, and an open position, in which the dropper nose is uncovered from the closure, wherein the closure comprises an end wall forming an outward planar end face and, opposite thereof, an inner face that comprises a sealing bulge, wherein the dropper nose has a free end forming an outlet channel having a first portion, a second portion, and a third portion, wherein the first portion tapers toward the outlet, wherein the second and third outlet channels each conically widen toward the free end, wherein the end wall forms a first thickness between the vertex of the sealing bulge and the end face and a second thickness between a marginal area adjacent the sealing bulge and the end face, wherein the ratio between the first and second thickness is between 1.4 and 1.6, wherein a movement of the closure from the closed position toward the open position causes the sealing bulge to slide off from the free end in a direction laterally from a longitudinal axis of the dropper nose.

2. The flip-top cap of claim 1 wherein the dispensing outlet has a diameter of 2.8 mm.

3. The flip-top cap of claim 1, wherein the sealing bulge protrudes in a direction away from the inner face at a circular cross-section that reduces in diameter in the direction away from the inner face.

4. The flip-top cap of claim 3, wherein the sealing bulge is dome-shaped.

5. The flip-top cap of claim 4, wherein the dome-shape comprises a spherical surface having a radius of 4 mm.

6. The flip-top cap of claim 1, wherein the base forms a cylindrical shoulder, wherein the shoulder and the closure snugly fit with each other in the closed position.

7. The flip-top cap of claim 1, comprising a first retention structure at the closure and a second retention structure at the base and wherein the first and second retention structure are snapped into each other in the closed position.

8. The flip-top cap of claim 1, comprising an inner thread for mating with an outer thread of a container bottle.

9. The flip-top cap of claim 8, comprising the container bottle, wherein the container bottle and the flip-top cap in combination form a dispenser for the dental material.

10. The flip-top cap of claim 8, comprising the dental material contained in the container bottle.

11. The flip-top cap of claim 1, wherein the hinged connection between the closure and the base is formed by a bistable living hinge which urges the closure and the base to either of the closed and open position.

12. The flip-top cap of claim 11, wherein the closure and the base are pivotable by 180 degrees for establishing the open and the closed position.

13. The flip-top cap of claim 1, wherein the closure entirely encapsulates the dropper nose in the closed position.

14. The flip-top cap of claim 1, wherein a wall thickness of the third portion of the dropper nose is thinner at the dispensing outlet than a wall thickness of the second portion of the dropper nose.

* * * * *